US007222609B2

(12) United States Patent
Benzin et al.

(10) Patent No.: US 7,222,609 B2
(45) Date of Patent: May 29, 2007

(54) FUEL SUPPLY SYSTEM

(75) Inventors: Carsten Benzin, Frankfurt am Main (DE); Bernd Lienemann, Kelkheim (DE); Alexander Sonntag, Schwalbach (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 11/211,797

(22) Filed: Aug. 24, 2005

(65) Prior Publication Data

US 2006/0060250 A1 Mar. 23, 2006

(30) Foreign Application Priority Data

Aug. 25, 2004 (DE) ..... 10 2004 041 203

(51) Int. Cl.
*F02M 37/04* (2006.01)
*F02M 37/08* (2006.01)

(52) U.S. Cl. ..... 123/509; 137/255

(58) Field of Classification Search ..... 123/509, 123/510, 198 D; 137/565.33, 571, 118.01, 137/255

See application file for complete search history.

(56) References Cited

U.S. PATENT DOCUMENTS 4,286,624 A * 9/1981 Clausen et al. ..... 137/625.19
4,860,714 A * 8/1989 Bucci ..... 123/514
4,951,699 A * 8/1990 Lipman ..... 137/142
5,331,994 A * 7/1994 Bryan et al. ..... 137/1
5,732,684 A * 3/1998 Thompson ..... 123/514
6,276,342 B1 * 8/2001 Sinz et al. ..... 123/514
6,283,142 B1 * 9/2001 Wheeler et al. ..... 137/265
6,553,973 B1 * 4/2003 Coha et al. ..... 123/509
6,845,782 B2 * 1/2005 Osterkil et al. ..... 137/1
6,851,396 B2 * 2/2005 Fromont ..... 123/1 A
7,051,716 B2 * 5/2006 Maasz ..... 123/509
7,069,913 B1 * 7/2006 Crary ..... 123/509
2006/0112937 A1 * 6/2006 Tittmann ..... 123/510

FOREIGN PATENT DOCUMENTS

DE 44 00 213 C2 11/1994
DE 43 35 858 A1 4/1995
DE 199 32 356 A1 2/2000

OTHER PUBLICATIONS

2007q02301 training material "valve" please see the links: http://at.smc.at/files/Lehrgang1.pdf http:/www.christiani-akademi.de/fileadmin/Pdfs/Musterautomatisierung.pdf.

* cited by examiner

*Primary Examiner*—Mahmoud Gimie
(74) *Attorney, Agent, or Firm*—Mayer, Brown, Rowe & Maw LLP

(57) ABSTRACT

In the case of a fuel supply system for supplying an internal combustion engine (2) of a motor vehicle via two feed units (5, 5'), a mixer valve is arranged in a connecting piece (11, 12) connecting the feed units (5, 5'). The mixer valve has a moveable valve body between two mutually opposite valve seats. When only one of the feed units (5, 5') is switched on, the connection to the other feed unit (5, 5') is interrupted. This prevents fuel being fed by a feed unit (5, 5') which is switched off.

10 Claims, 2 Drawing Sheets

FUEL SUPPLY SYSTEM

BACKGROUND OF THE INVENTION

The invention relates to a fuel supply system for supplying an internal combustion engine of a motor vehicle, having two feed means, which are arranged in a fuel tank, for feeding fuel, and having a connecting piece for guiding the fuel fed by the feed means from two inlets, which are each connected to the feed means, to an outlet.

Fuel supply systems of this type are used, for example, for motor vehicles having a high power consumption and narrow fuel tanks, in which an individual feed means is frequently insufficient in terms of power, and are known in practice. Furthermore, fuel supply systems of this type are used in what are referred to as saddle tanks, in which the fuel tank has two chambers, with suction jet pumps which feed fuel into one or two baffles additionally being arranged in the individual chambers. The connecting pieces combine a flow from two lines, for example from the feed units, into one fuel line leading to the internal combustion engine or to one or two suction jet pumps. The connecting pieces of the known fuel supply system are conventional T-pieces.

A disadvantage of the known fuel supply system is that, for example, if one of two feed means is in operation, fuel may overflow from one of the feed means to the feed means which has been switched off. This results in an unnecessary circulation of the fuel and to energy losses in the feeding of the fuel to the internal combustion engine. In order to avoid this problem, a practical remedy is to use a respective nonreturn valve between the inlets and the feed means. However, this results in a very large structural outlay on the fuel supply system.

The invention is based on the problem of developing a fuel supply system of the type mentioned at the beginning in such a manner that an unnecessary overflowing of the fuel via the connecting piece is avoided and that the fuel supply system is constructed in a particularly simple manner.

BRIEF DESCRIPTION OF THE INVENTION

This problem is solved according to the invention by the connecting piece having a mixer valve and by, when there is a difference in pressure between the inlets, the mixer valve closing the inlet with the low pressure.

This design makes it possible for the mixer valve to prevent fuel from being able to overflow from one inlet to the other inlet. In the case of two feed units which are connected to the inlets but only one of which is in operation, fuel can therefore be prevented from overflowing to the feed unit which has been switched off. Furthermore, the fuel supply system according to the invention does not require any additional nonreturn valves in the lines leading from the feed units to the connecting piece. The fuel supply system according to the invention is therefore composed of particularly few components which are to be assembled, and is therefore constructed in a particularly simple manner. Of course, by connecting a plurality of mixer valves one behind another, more than two feed means can be connected to a single outlet for the connection of a single fuel line. According to one advantageous development of the invention, the connection of the fuel flows fed by the feed means is structurally particularly simple if the inlets each have a valve seat, and if between the valve seats a valve body is guided moveably by the pressure in the inlets, and if the distance between the valve seats is greater than the width of the valve body. To avoid periodically occurring pressure fluctuations, the movement of the valve body may of course also be damped.

When there is approximately identical pressure in the inlets, the consumer can be supplied with fuel, according to one advantageous development of the invention, via the two feed means if in a central position of the valve body between the valve seats the two inlets are connected to the outlet. This ensures that, when the internal combustion engine requires a large quantity of fuel, both feed units can feed fuel jointly.

According to another advantageous development of the invention, a forward flow line leading to the internal combustion engine can be prevented from running dry if a nonreturn valve is arranged between the mixer valve and the outlet.

During a supplying of suction jet pumps with fuel, a pipette effect can be avoided, according to another advantageous development of the invention, if a control valve is arranged between the mixer valve and the outlet, which control valve, in the unpressurized state, connects the outlet to an opening leading into the fuel tank and, in the pressurized state, closes the opening. By means of this design, when the feed means are feeding, the opening is closed and fuel flows from the mixer valve of the connecting piece to the outlet and therefore to the suction jet pumps. However, when the feed means are switched off, the control valve prevents fuel from being sucked up via the outlet.

The installation of the fuel supply system according to the invention becomes particularly simple if the mixer valve together with the control valve or the nonreturn valve is designed as a structural unit. This makes it possible to preassemble the mixer valve together with the control valve or together with the nonreturn valve outside the fuel tank to form the structural unit and subsequently to insert it with little outlay into the fuel tank.

The fuel supply system according to the invention is manufactured particularly cost-effectively if the mixer valve and the control valve or the nonreturn valve have a common housing.

The manufacturing costs of the fuel supply system according to the invention are further reduced if the mixer valve and/or the control valve and/or the nonreturn valve have straight channels for receiving the valve body, and if the channels are closed by a closure means. The closure means is preferably designed as a cap or stopper connected to the housing in a form-fitting manner.

According to another advantageous development of the invention, the mixer valve becomes structurally particularly simple if one of the valve seats of the mixer valve is arranged in the closure means and the other of the valve seats is arranged in the housing.

If the feed means are divided into a basic-load feed means and a peak-load feed means, one of the inlets can easily be closed in the basic position if the valve body of the mixer valve is prestressed into a designated position.

According to another advantageous development of the invention, the guiding of the valve body between the two valve seats requires a particularly low outlay if the valve body of the mixer valve is designed as a ball.

BRIEF DESCRIPTION OF THE DRAWINGS

The invention permits numerous embodiments. To further clarify its basic principle, a number of embodiments are illustrated in the drawing and are described below. In the drawing

DETAILED DESCRIPTION OF THE INVENTION

Figure 1:
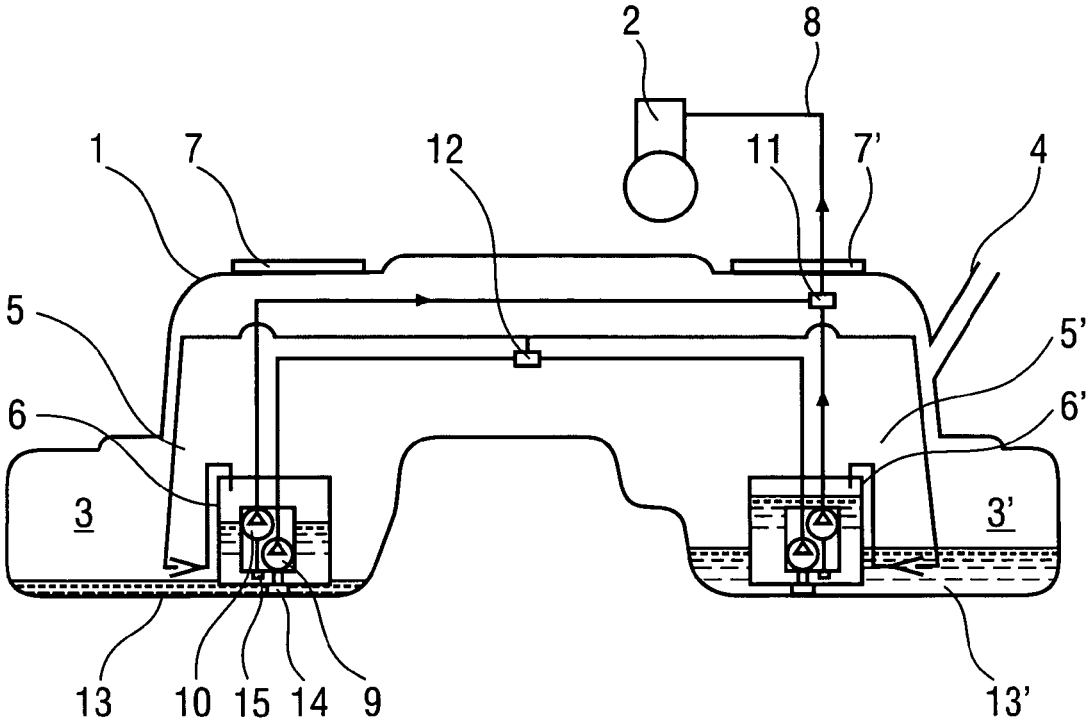
FIG. 1 shows diagrammatically a fuel supply system according to the invention with two feed units.

FIG. 1 shows a fuel tank 1 for a motor vehicle with a fuel supply system for supplying an internal combustion engine 2 with fuel. The fuel tank 1 is designed as a saddle tank with two chambers 3, 3' and has a filler neck 4. The fuel supply system has two feed units 5, 5' each having a baffle 6, 6'. Directly above the feed units 5, 5', the fuel tank 1 has installation flanges 7, 7'. A forward flow line 8 routed from the feed units 5, 5' to the internal combustion engine 2 is guided through one of the installation flanges 7'. The system here is what is referred to as a fuel supply system without a return flow, in which fuel which is not consumed by the internal combustion engine 2 is not returned to the fuel tank 1.

The feed units 5, 5' are in each case electrically driven and in each case have a preliminary stage 9 and a main stage 10. The main stages 10 feed fuel from the baffles 6, 6' via a first connecting piece 11 to the internal combustion engine 2. The preliminary stages 9 feed fuel from the baffles 6, 6' via a second connecting piece 12 to suction jet pumps 13, 13' arranged in the chambers 3, 3'. The suction jet pumps 13, 13' are thereby supplied with fuel as motive agent and feed fuel from the chambers 3, 3' into the baffles 6, 6'. Furthermore, the baffles 6, 6' each have a bottom valve 14 via which fuel flows from the fuel tank 1 into the baffles 3, 3'. Filters 15 of the main stages 10 are arranged in the baffles 6, 6'. The feed units 5, 5' can be operated individually or together in accordance with the requirements of the internal combustion engine 2. If the internal combustion engine 2 requires a low amount of fuel, one of the feed units 5, 5' is therefore switched off.

Figure 2:
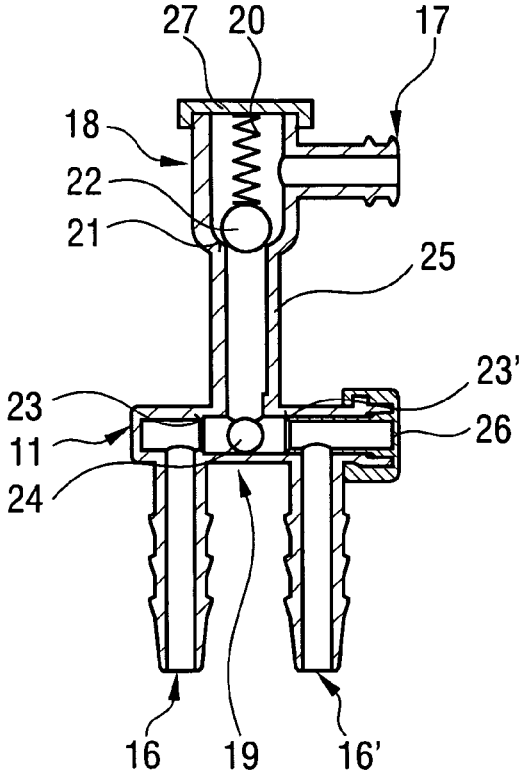
FIG. 2 shows a sectional illustration through a first valve of the fuel supply system from FIG. 1.

FIG. 2 shows the first connecting piece 11 of the fuel supply system from FIG. 1 in a sectional illustration. It can be seen here that the connecting piece 11 has two inlets 16, 16' which are each connected to the main stages 10 of the feed units 5, 5' from FIG. 1. Furthermore, the connecting piece 11 has an outlet 17 to which the forward flow line 8, which is illustrated in FIG. 1 and leads to the internal combustion engine 2, can be connected. The connecting piece 11 has a nonreturn valve 18 and a mixer valve 19. The nonreturn valve 18 has a valve body 22 which is prestressed against a valve seat 21 by a spring element 20. If neither of the feed units 5, 5' illustrated in FIG. 1 is feeding fuel, the spring element 20 presses the valve body 22 against the valve seat 21 and closes the outlet 17. This prevents the forward flow line 8 from running dry. If at least one of the feed units 5, 5' is feeding, the valve body 22 of the nonreturn valve 18 is pressed away from the valve seat 21 and fuel flows to the outlet 17 of the first connecting piece 11 and therefore into the forward flow line 8. The mixer valve 19 has a valve body 24 which is guided moveably between two valve seats 23, 23' and is designed as a ball. If only one of the feed units 5, 5' from FIG. 1 is feeding, the valve body 24 is pressed against one of the valve seats 23, 23' and therefore closes the inlet 16, 16' of the other feed unit 5, 5'. This prevents fuel which is fed by the one feed unit 5, 5' from being fed back into the fuel tank 1 by the other feed unit 5, 5' which has been switched off. If both feed units 5, 5' illustrated in FIG. 1 are feeding fuel, the pressure at the valve body 24 of the mixer valve 19 is in equilibrium, as a result of which the valve body 24, as illustrated in FIG. 2, is held between the valve seats 23, 23'. Neither of the inlets 16, 16' is therefore blocked, and both feed units 5, 5' feed fuel through the nonreturn valve 18 to the outlet 17 leading to the internal combustion engine 2. The first connecting piece 11 has a common housing 25 for the mixer valve 19 and the nonreturn valve 18. The mixer valve 19 and the nonreturn valve 18 are in each case tightly closed by a cap 26, 27.

Figure 3:
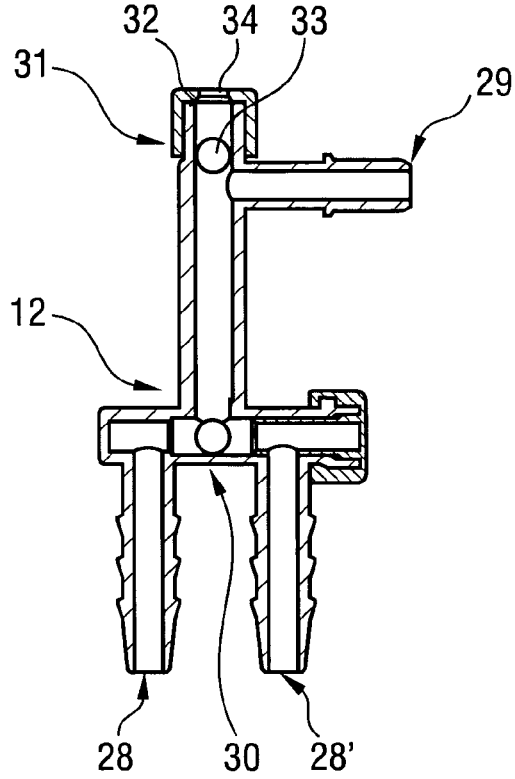
FIG. 3 shows a sectional illustration through a second valve of the fuel supply system from FIG. 1.

FIG. 3 shows the second connecting piece 12 of the fuel supply system from FIG. 1, with two inlets 28, 28' for connecting the preliminary stages 9 of the feed units 5, 5' from FIG. 1 and an outlet 29 to which the two suction jet pumps 13, 13' can be connected. The second connecting piece 12 has a mixer valve 30 which is constructed in the manner of the mixer valve 19 of the first valve 11 from FIG. 2. Furthermore, the second connecting piece 12 has behind the mixer valve 30, as seen in the direction of flow, a control valve 31 with a valve body 33 which is kept away from a valve seat 32 by gravity. As seen from the valve body 33, the control valve 31 has behind the valve seat 32 an opening 34 leading into the fuel tank 1. When at least one of the feed units 5, 5' of the fuel supply system from FIG. 1 is feeding, the valve body 33 is pressed against the valve seat 32 and closes the opening 34. Fuel is therefore fed via the outlet 29 to the suction jet pumps 13, 13' illustrated in FIG. 1. If both feed units 5, 5' are switched off, the valve body 33 of the control valve 31 is pressed by gravity from the valve seat 32 into the position illustrated. The outlet 29 is thereby connected to the opening 34 leading into the fuel tank 1. Air therefore passes into the lines leading to the suction jet pumps 13, 13'. A pipette effect which would lead to fuel being sucked up by the preliminary stages 9 of the feed units 5, 5' is therefore prevented.

Figure 4:
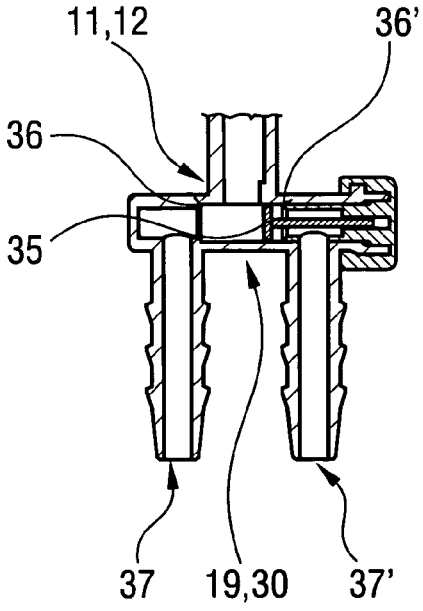
FIG. 4 shows a mixer valve in a further embodiment of the first or second valve from FIG. 1.

FIG. 4 shows a further embodiment of the mixer valve 19, 30 of the first or second connecting piece 11, 12 which differs from that from FIGS. 2 and 3 only by the fact that a valve body 35 guided between two valve seats 36, 36' is of disk-shaped design. Furthermore, in an embodiment which is not illustrated, the valve body 35 may also be prestressed by a spring element into the central position, for example. If the feed units 5, 5' from FIG. 1 are divided into a basic-load feed unit 5, 5' and a peak-load feed unit 5, 5', the valve body 33 can alternatively also be prestressed against the valve seat 36, 36' leading to the peak-load feed unit 5, 5'. An inlet 37, 37' leading to the peak-load feed unit 5, 5' is therefore always closed if the internal combustion engine 2 from FIG. 1 does not require an increased amount of fuel.

Figure 5:
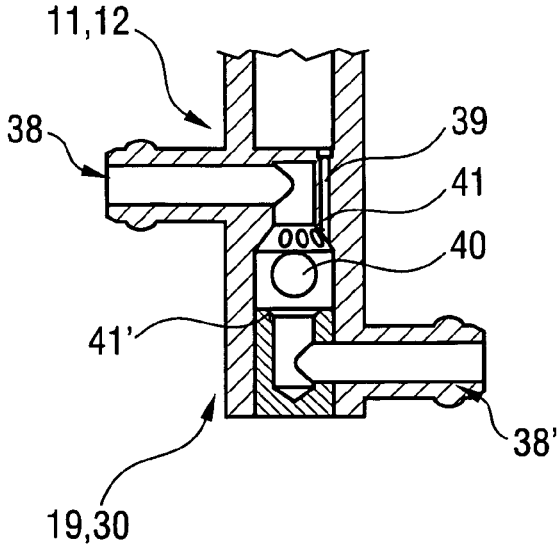
FIG. 5 shows the mixer valve in a further embodiment of the first or second valve from FIG. 1.

FIG. 5 shows a further embodiment of the mixer valve 19, 30 for the first or second valve 11, 12 from FIG. 1, with two inlets 38, 38', in which a channel 39 leading to the control valve 31 from FIG. 3 or to the nonreturn valve 18 from FIG. 2 is guided under one of the inlets 38. As in the embodiments of the mixer valve 19, 30 from FIGS. 2 and 3, a valve body 40 is guided moveably between two valve seats 41, 41'.

The invention claimed is:

1. A fuel supply system for supplying an internal combustion engine of a motor vehicle, having two feed means, which are arranged in a fuel tank, for feeding fuel, and having a connecting piece for guiding the fuel fed by the feed means from two inlets, which are each connected to the feed means, to an outlet, characterized in that the connecting piece has a mixer valve, and in that, when there is a difference in pressure between the inlets, the mixer valve closes the inlet with the low pressure.

2. A fuel supply system for supplying an internal combustion engine of a motor vehicle, having two feed means, which are arranged in a fuel tank, for feeding fuel, and having a connecting piece for guiding the fuel fed by the feed means from two inlets, each inlet having a valve seat, a valve body movable between the valve seats in response to the pressure existing at the inlets is guided movably by the pressure in the inlets, and in that the distance between the valve seats is greater than the width of the valve body.

3. The fuel supply system as claimed in claim 1 or 2, characterized in that in a central position of the valve body between the valve seats the two inlets are connected to an outlet.

4. The fuel supply system as defined in claim 3, characterized in that a nonreturn valve is arranged between the mixer valve and the outlet.

5. The fuel supply system as defined in claim 1, characterized in that a control valve is arranged between the mixer valve and the outlet, which control valve, in the unpressurized state, connects the outlet to an opening leading into the fuel tank and, in the pressurized state, closes the opening into the fuel tank.

6. The fuel supply system as defined in claim 5, characterized in that the mixer valve together with the control valve and the nonreturn valve is designed as a constructional unit.

7. The fuel supply system as defined in claim 6, characterized in that the mixer valve and the control valve or the nonreturn valve have a common housing.

8. The fuel supply system as defined in claim 5, characterized in that the mixer valve and/or the control valve and/or the nonreturn valve have straight channels for receiving a valve body, and in that the channels are closed by a closure means.

9. The fuel supply system as defined in claim 7, characterized in that one of the valve seats of the mixer valve is arranged in the closure means and the other of the valve seats is arranged in the housing.

10. The fuel supply system as defined in claim 9, characterized in that the valve body of the mixer valve is designed as a ball.

* * * * *